United States Patent [19]

Neuroth

[11] Patent Number: 4,536,609

[45] Date of Patent: Aug. 20, 1985

[54] OIL WELL ELECTRICAL CABLE WITH GAS CONDUCTING CHANNEL AND VENT

[75] Inventor: David H. Neuroth, Bethany, Conn.

[73] Assignee: Harvey Hubbell Incorporated, Orange, Conn.

[21] Appl. No.: 511,143

[22] Filed: Jul. 6, 1983

[51] Int. Cl.[3] ..... H01B 7/18

[52] U.S. Cl. ..... 174/11 R; 174/102 SP

[58] Field of Search ..... 174/11 R, 13, 16 R, 174/113 R, 102 R, 102 SP

[56] References Cited

U.S. PATENT DOCUMENTS

| | | | |
|---|---|---|---|
| 3,571,486 | 3/1971 | Kennedy | 174/11 R |
| 3,742,363 | 6/1973 | Carle | 174/102 R |
| 4,088,830 | 5/1978 | Wargin et al. | 174/113 R |

*Primary Examiner*—Laramie E. Askin

*Attorney, Agent, or Firm*—Jerry M. Presson; Alfred N. Goodman; Darle M. Short

[57] ABSTRACT

An electrical cable especially useful in oil wells having a gas conducting channel beneath the outer sheath and a valved vent through the sheath to prevent explosive decompression. Gases entrained in the cable's insulation can exit from the insulation into the channel, move longitudinally of the cable along the channel and exit from the sheath via the vent. The cable comprises an insulated conductor, a low gas-permeable sheath surrounding the insulation, the gas conducting channel located between the insulation and the sheath, and the vent in the sheath and communicating with the channel. The channel can be formed of a plurality of filaments or fibers located closely adjacent one another to form a bundle. A plurality of bundles can be used, which can extend linearly or spirally along the insulation or in interwoven form.

21 Claims, 6 Drawing Figures

OIL WELL ELECTRICAL CABLE WITH GAS CONDUCTING CHANNEL AND VENT

FIELD OF THE INVENTION

The invention relates to electrical cable which is especially useful in oil wells. The cable has a gas conducting channel beneath the outer sheath and a valved vent through the sheath to allow entrained gas to exit from the cable to prevent explosive decompression during rapid removal of the cable from the well or a rapid pump down of the well.

BACKGROUND OF THE INVENTION

Electrical cables used in the newer and deeper oil wells to power such things as pumps are subject to high pressures due to the static head of liquid in the well. These pressures can be on the order of about 3,000 psi. These liquids are typically oil and water and are carriers of dissolved gases such as carbon dioxide, methane and hydrogen sulfide. After a cable is inserted into an oil well, these gases tend to migrate through the outer protective sheath into the permeable cable insulation, which is typically formed of rubber. The rate of migration of these gases into the insulation is slowed by the outer sheath which is usually formed of thermoplastic or metallic material and therefore has a low gas-permeability.

However, after a period of time, gases will pass through the outer sheath and saturate the rubber insulation. This process of "loading" of the cable with gases may take many months as the gases slowly migrate into the cable through the outer sheath or through various splices where the chemical barrier formed by the sheath has been removed.

While the cable is located in the well, these gases do not present a significant problem. However, when the cable is suddenly removed from the well or the static head of liquid is removed by a rapid "pump down", the absorbed gases in the insulation will try to escape due to a rapid decompression as the outer pressure on the cable reduces.

Since the outer sheath has a low gas-permeability, these gases cannot pass therethrough rapidly. Thus, the rapid decompression of the cable can cause an explosion, resulting in severe damage to the cable, or a rushing of gases through the splice, resulting in splice damage.

Conventional cables have not encountered this problem since conventional wells are not very deep and there is no significant decompression upon removing the cable or pumping down the well. Thus, conventional armor sheaths can withstand the typical decompressive pressures.

However, with the ever increasing depth of new oil wells, significant decompressive pressure changes can result.

SUMMARY

Accordingly, a primary object of the invention is to provide an electrical cable especially useful in oil wells which can resist explosive decompression and damage to splices.

Another object of the invention is to provide such an oil well electrical cable that can bleed off gas pressures via a gas conducting channel and a vent.

Another object of the invention is to provide such an oil well electrical cable that is relatively simple to manufacture and construct but will not affect the electrical conductivity of the cable.

The foregoing objects are basically attained in an oil well electrical cable comprising a conductor, a layer of gas-permeable insulation surrounding the conductor and a low gas-permeable sheath surrounding the insulation, the improvement comprising: channel means extending longitudinally of the cable inside the sheath, for defining a gas-permeable channel to conduct, longitudinally of the cable, gases located in the insulation; and vent means, in communication with the channel means, for venting gases conducted along the channel means through the sheath to the exterior thereof.

Advantageously, the gas conducting channel extends between the insulation and the sheath and is formed from a plurality of thin, elongated members such as synthetic filaments or natural fibers located closely adjacent one another to form a bundle, the gases travelling longitudinally of the cable between and along the filaments or fibers.

Other objects, advantages and salient features of the invention will become apparent from the following detailed description which, taken in conjunction with the annexed drawings, discloses preferred embodiments of the invention.

DRAWINGS

Referring now to the drawings which form a part of this original disclosure:

DETAILED DESCRIPTION OF THE INVENTION

Figure 2:
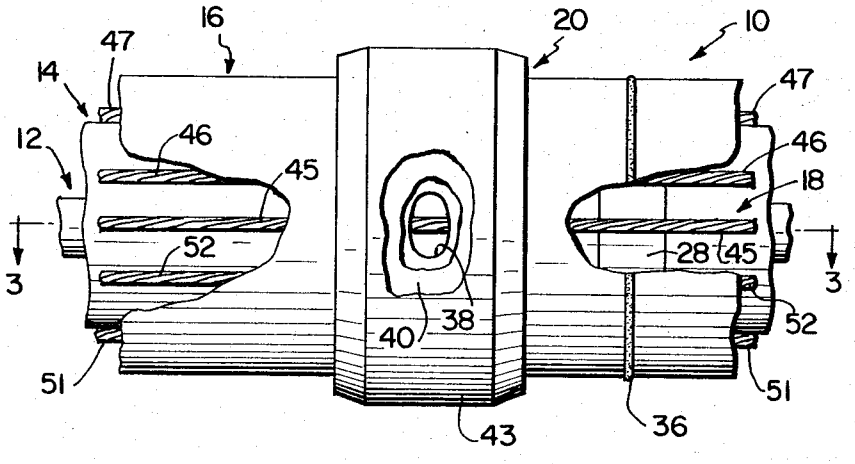
FIG. 2 is an enlarged, side elevational view with parts cut away of the cable shown in FIG. 1.

Referring now to FIGS. 1–4, the cable 10 in accordance with the invention comprises a conductor 12, a layer of gas-permeable insulation 14 surrounding the conductor, a low gas-permeable sheath 16 surrounding the insulation, a gas conducting channel assembly 18 extending longitudinally of the cable, and a vent assembly 20 for venting gases conducted along the channel assembly through the sheath to the exterior thereof.

The conductor 12 is comprised of a pair of individual, separate conductors 22 and 23 which are electrically connected via a weld 24 or a crimped connector in a splice. These separate conductors form a cylindrical core inside the insulation and can be formed of a solid metallic wire or metallic strands.

Figure 3:
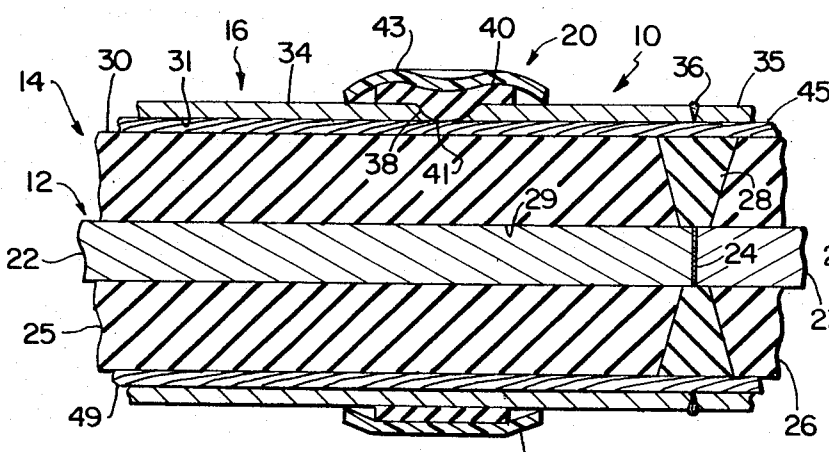
FIG. 3 is a side elevational view of the cable shown in FIG. 2 in cross section taken along lines 3—3 in FIG. 2 showing the details of the vent and valve member.

The insulation 14 is formed from two separate, individual cylindrical insulation members 25 and 26 which are spliced together by a ring 28 of insulation which surrounds the weld 24. The insulation members are formed from rubber or rubber based material which is porous or highly permeable to gas. As seen in FIG. 3, the inner cylindrical surface 29 of the insulation 14 is adjacent to the outer surface of the conductor 12, while the outer cylindrical surface 30 of the insulation is adjacent to the inner cylindrical surface 31 of sheath 16.

The sheath 16 is formed from two separate individual sheath members 34 and 35 which are coupled together in a splice via a weld 36 or a tape. A chemical barrier is provided by the sheath to resist penetration of gases. However, this chemical barrier is typically removed at the weld 36, thereby providing an area for gas penetration. The sheath is essentially cylindrical and is advantageously formed from lead or thermoplastic material.

As seen in FIGS. 1–4, an orifice 38 is formed in the wall of the sheath and passes completely therethrough to form a vent in the sheath. This orifice can be several inches or feet away from the splice, one orifice being located on each side of a splice.

Surrounding the sheath and located over orifice 38 is a first elastic band 40 having a radially inwardly extending projection 41 engageable in the orifice 38 and a second elastic band 43 surrounding the first band and having a wider width. The first elastic band 40 is advantageously formed of rubber and is vulcanized in place over the sheath so that the projection 41 is formed radially inwardly to assume substantially the shape of the orifice 38. Advantageously, that orifice tapers radially inwardly, is oval in top plan view seen in FIG. 2, and has an outer edge which is saddle-shaped. The second elastic band is advantageously formed of heat-shrinkable plastic and is heat shrunk over the first elastic band as seen in FIG. 3 so that its outer edges engage the outer surface of the sheath 16.

Thus, the vent assembly 20 is formed by the orifice 38 which forms a vent and the first and second elastic bands 40 and 43 which in combination with projection 41 form a one-way valve member. This valve member normally closes orifice 38 as seen in FIG. 3, but on the escape of gases from the inside of the sheath will be opened, thereby exposing orifice 38 to the exterior of the sheath.

The gas conducting channel assembly 18 is comprised of a plurality of bundles 45–52 of synthetic filaments or natural fibers which are located between the outer cylindrical surface 30 of the insulation and the inner cylindrical surface 31 of the sheath. These bundles as seen in FIGS. 1–4 extend linearly, i.e., in a straight line, longitudinally of the cable and each is formed from a plurality of filaments or fibers which are located closely adjacent one another, loosely grouped together, woven together, braided together, or spirally wrapped together as a roving to define interstices for the gas to pass therealong and transversely therethrough. These synthetic filaments can be formed from glass, nylon, Kynar, polymeric materials or mixtures thereof. The natural fibers can be formed from minerals, plants such as cotton, animal hair or mixtures thereof.

Thus, when gases are entrained in the insulation 14 after long periods of immersion in a liquid filled oil well and then the cable experiences a rapid well pump down or rapid removal, expansion of these gases due to decompression will be bled off via the gas conducting channel assembly 18 and the vent assembly 20. In particular, the gas tends to exit from the insulation in a radially outward direction and then encounters the gas conducting channel assembly 18 formed from the bundles 45–52. Since these bundles are formed from a plurality of filaments or fibers that are located closely adjacent one another, they in essence form channels of low gas-permeability along and through which the gas can move longitudinally of the cable. This is indicated by the arrows in FIG. 4.

In essence, the bundles form channels which are incompressible to the extent that they provide high gas-permeable channels. This is necessary since decompression tends to outwardly expand the rubber insulation, causing it to tightly engage the inside of the sheath and thereby closing off an area of otherwise high gas-permeability.

Figure 4:
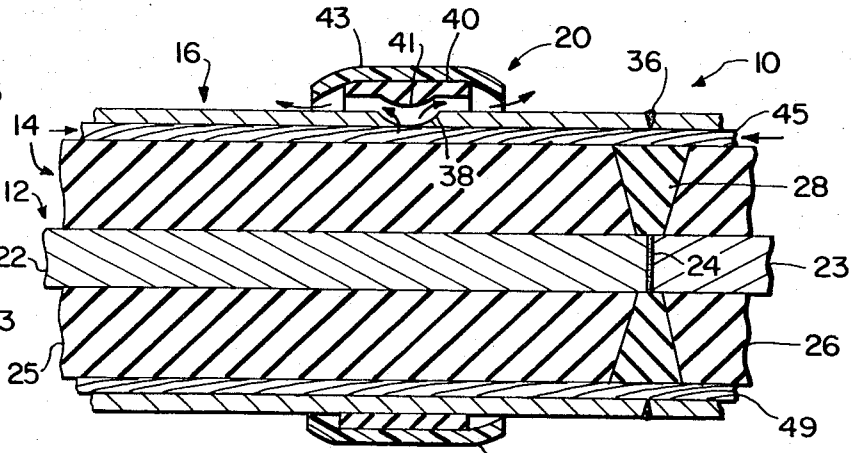
FIG. 4 is a view similar to that shown in FIG. 3 except that the valve member has been moved away from the vent, thereby opening the vent, via the escape of gases.

When the gas moves along these bundles, it will encounter the orifice 38, which represents an area of higher gas-permeability than the remaining part of the sheath. Thus, the pressure of the gas expanding outwardly will move the first and second elastic bands 40 and 43 radially outwards as seen in FIG. 4 over the orifice 38 so that projection 41 is removed radially outwardly from the orifice. The gas then passes by the remaining parts of the elastic bands to the exterior of the sheath.

EMBODIMENT OF FIG. 5

Figure 1:
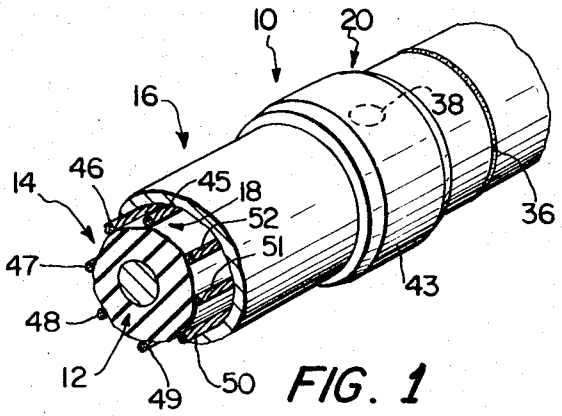
FIG. 1 is a fragmentary perspective view of the oil well electrical cable in accordance with the invention.
Figure 5:
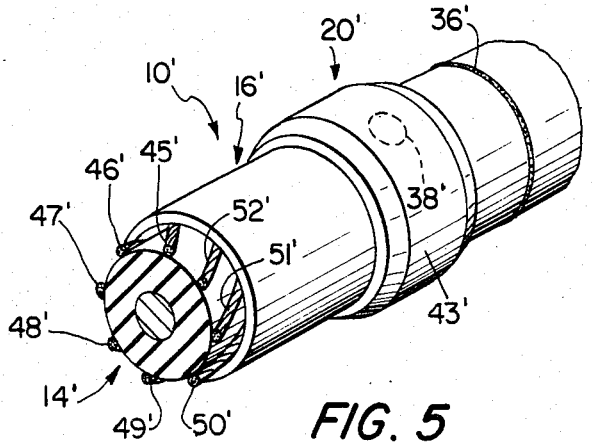
FIG. 5 is a fragmentary perspective view of a second embodiment of the oil well electrical cable in which a plurality of bundles of filaments or fibers are spirally wrapped around the insulation of the cable.

As shown in FIG. 5, a modified oil well electrical cable 10' in accordance with the invention is shown which is similar to that shown in FIG. 1 except that the bundles 45'–52' are spirally wrapped around the outside of the insulation 14'. The remaining parts are the same as those discussed above regarding FIGS. 1–4 and are merely given a prime. The spiral wrapping adds flexibility to the overall cable.

EMBODIMENT OF FIG. 6

Figure 6:
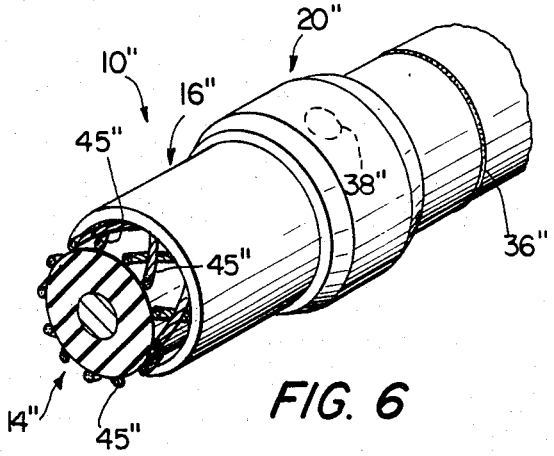
FIG. 6 is a fragmentary perspective view of another modified embodiment of the oil well cable in accordance with the invention in which the plurality of bundles are interwoven.

As seen in FIG. 6, a second modified embodiment of the cable in accordance with the invention is shown comprising cable 10'' in which all of the parts shown in FIGS. 1–4 and described above are the same except that the bundles 45'' are interwoven to form a layer between the insulation 14'' and the sheath 16''. The remaining parts are the same and are thus given a double prime. This interweaving of the bundles 45'' can be in an open regular mesh or a braid and can be applied in a spiral tape, or a longitudinal tape that can completely or partially enclose the insulation 14''.

While advantageous embodiments have been chosen to illustrate the invention, it will be understood by those skilled in the art that various changes and modifications can be made therein without departing from the scope of the invention as defined in the appended claims.

What is claimed is:

1. An oil well electrical cable comprising:

a conductor;

a layer of gas-permeable insulation surrounding the conductor;

a low gas-permeable sheath surrounding the insulation;

channel means, extending longitudinally of the cable between the insulation and the sheath, for defining a gas-permeable channel to conduct, longitudinally of the cable, gases exiting from the insulation; and vent means, in communication with said channel means, for venting gases conducted along said channel means through the sheath to the exterior thereof;

said vent means comprising an orifice formed through the wall of the sheath and a one-way valve member for normally closing said orifice but allowing opening thereof by gases conducted thereto by said channel means.

2. A cable according to claim 1, wherein said channel means comprises a plurality of thin, elongated members located closely adjacent one another to form a bundle, the gases travelling longitudinally of the cable between and along said elongated members.

3. A cable according to claim 2, wherein said channel means comprises a plurality of bundles.

4. A cable according to claim 2, wherein said bundle extends substantially linearly longitudinally of the cable.

5. A cable according to claim 2, wherein said bundle extends spirally longitudinally of the cable.

6. A cable according to claim 2, wherein said channel means comprises a plurality of bundles, said bundles being interwoven.

7. A cable according to claim 1, wherein said one-way valve member comprises a first elastic band received around the periphery of the sheath over said orifice.

8. A cable according to claim 7, wherein said first elastic band includes a projection extending radially inwardly of the cable and engageable in said orifice.

9. A cable according to claim 7, wherein said one-way valve member further comprises a second elastic band received over said first elastic band.

10. An oil well electrical cable comprising:

a conductor;

a layer of gas-permeable insulation surrounding the conductor;

a low gas-permeable sheath surrounding the insulation;

channel means, extending longitudinally of the cable inside the sheath, for defining a gas-permeable channel to conduct, longitudinally of the cable, gases located in the insulation;

said channel means comprising an elongated member having a greater gas permeability than said insulation; and vent means, in communication with said channel means, for venting gases conducted along said channel means through the sheath to the exterior thereof.

11. A cable according to claim 10, wherein said elongated member comprises a plurality of thin, elongated filaments located closely adjacent one another to form a bundle, the gases travelling longitudinally of the cable between and along said elongated filaments.

12. A cable according to claim 11, wherein said channel means comprises a plurality of elongated members.

13. A cable according to claim 10 wherein said elongated member is comprised of a material having a greater gas permeability than said insulation.

14. In an oil well electrical cable comprising a conductor, a layer of gas-permeable insulation surrounding the conductor and a low gas-permeable sheath surrounding the insulation, the improvement comprising:

channel means, extending longitudinally of the cable between the insulation and the sheath, for defining a gas-permeable channel to conduct, longitudinally of the cable, gases located in the insulation; and vent means, in communication with said channel means, for venting gases conducted along said channel means through the sheath to the exterior thereof, said channel means comprising a plurality of thin, elongated members located closely adjacent one another to form a bundle, the gases travelling longitudinally of the cable between and along said elongated members.

15. A cable according to claim 14, wherein said channel means comprises a plurality of bundles.

16. A cable according to claim 14, wherein said bundle extends substantially linearly longitudinally of the cable.

17. A cable according to claim 14, wherein said bundle extends spirally longitudinally of the cable.

18. A cable according to claim 14, wherein said channel means comprises a plurality of bundles, said bundles being interwoven.

19. A cable according to claim 14, wherein said vent means comprises an orifice formed through the wall of the sheath, and a one-way valve member for normally closing said orifice but allowing opening thereof by gases conducted thereto by said channel means, said one-way valve member comprises a first elastic band received around the periphery of the sheath over said orifice.

20. A cable according to claim 19, wherein said first elastic band includes a projection extending radially inwardly of the cable and engageable in said orifice.

21. A cable according to claim 19, wherein said one-way valve member further comprises a second elastic band received over said first elastic band.

* * * * *